US007938486B2

(12) United States Patent
Porat et al.

(10) Patent No.: US 7,938,486 B2
(45) Date of Patent: May 10, 2011

(54) POSTURE TRAINER

(75) Inventors: Gadi Porat, Jerusalem (IL); Yehuda Cohen, Jerusalem (IL); Adi Cohen, Jerusalem (IL)

(73) Assignee: Association for Public Health Services, Jerusalem (IL)

( * ) Notice: Subject to any disclaimer, the term of this patent is extended or adjusted under 35 U.S.C. 154(b) by 20 days.

(21) Appl. No.: 12/541,296

(22) Filed: Aug. 14, 2009

(65) Prior Publication Data

US 2010/0038944 A1 Feb. 18, 2010

Related U.S. Application Data

(60) Provisional application No. 61/136,199, filed on Aug. 18, 2008.

(51) Int. Cl.
*A47C 7/42* (2006.01)
*A47C 31/11* (2006.01)

(52) U.S. Cl. ..... 297/284.5; 297/228.1; 297/230.1; 297/230.11; 297/230.13

(58) Field of Classification Search ..... 297/228.1, 297/284.5, 230.1, 230.11, 230.13
See application file for complete search history.

(56) References Cited

U.S. PATENT DOCUMENTS 2,591,306 A * 4/1952 Sherman ..... 297/284.5
3,446,531 A * 5/1969 Froelich ..... 297/284.5
3,515,430 A * 6/1970 Nelson ..... 297/228.1 X
RE27,176 E * 9/1971 Froelich ..... 297/284.7
4,036,524 A * 7/1977 Takamatsu ..... 297/219.1
4,718,724 A * 1/1988 Quinton et al. ..... 297/284.5
4,862,536 A * 9/1989 Pruit ..... 297/284.5
5,113,176 A 5/1992 Harris
5,114,209 A * 5/1992 Dunn ..... 297/230.1
5,456,519 A * 10/1995 Davis ..... 297/230.13 X
5,551,752 A * 9/1996 Lovegrove et al. ..... 297/284.5
5,707,108 A * 1/1998 Pi ..... 297/230.14
5,816,654 A * 10/1998 Ellis ..... 297/284.5
5,863,095 A * 1/1999 Rivard et al. ..... 297/230.13
6,109,686 A 8/2000 Fox
6,257,665 B1 7/2001 Nagamitsu et al.
6,382,719 B1 * 5/2002 Heidmann et al. ..... 297/228.1
6,394,546 B1 * 5/2002 Knoblock et al. ..... 297/284.7
6,499,801 B1 * 12/2002 Peterson et al. ..... 297/228.13
6,669,286 B2 * 12/2003 Iusim ..... 297/217.4
(Continued)

FOREIGN PATENT DOCUMENTS

GB 2178652 A * 2/1987

*Primary Examiner* — Rodney B White
(74) *Attorney, Agent, or Firm* — Fleit Gibbons Gutman Bongini Bianco, PL; Paul D. Bianco; Martin Fleit

(57) ABSTRACT

An article for improving the posture of an individual sitting on a chair. The article includes a back covering member positionable on the back support portion of the chair and covering at least a portion thereof. The article is configured to annoy the individual when the individual is sitting in a manner deleterious to proper posture. The article includes a means for removably attaching the back covering member to the chair. There is also taught another article for improving the posture of an individual sitting on a chair. The article includes a seat covering member positionable on the seat support portion of the chair and covering at least a portion thereof. The article is configured to annoy the individual when the individual is sitting in a manner deleterious to proper posture. The article includes a means for removably attaching the seat covering member to the chair.

16 Claims, 6 Drawing Sheets

U.S. PATENT DOCUMENTS

| | | | | |
|---|---|---|---|---|
| 6,726,278 | B1 * | 4/2004 | Albright et al. | 297/228.1 X |
| 7,350,861 | B2 * | 4/2008 | Zaharakos | 297/228.1 |
| 7,625,046 | B2 * | 12/2009 | Sanchez | 297/353 |
| 2002/0171272 | A1 * | 11/2002 | Iusim | 297/217.4 |
| 2004/0056520 | A1 * | 3/2004 | Cho | 297/218.1 |
| 2004/0239161 | A1 * | 12/2004 | Lee | 297/217.3 |
| 2004/0245832 | A1 * | 12/2004 | Miller | 297/393 |
| 2006/0103196 | A1 * | 5/2006 | Zaharakos | 297/228.1 |
| 2006/0108850 | A1 * | 5/2006 | Miller | 297/393 |
| 2007/0236066 | A1 * | 10/2007 | Sanchez | 297/353 |
| 2008/0197688 | A1 * | 8/2008 | Tate | 297/464 |
| 2010/0038947 | A1 * | 2/2010 | Sanchez | 297/354.12 |

* cited by examiner

POSTURE TRAINER

CROSS REFERENCE TO RELATED APPLICATION

The present application claims priority from U.S. Provisional Application No. 61/136,199, filed on Aug. 18, 2008, herein incorporated by reference.

FIELD OF THE INVENTION

The present invention relates to an article which improves the posture of a sitting individual.

BACKGROUND OF THE INVENTION

It is a well documented phenomenon that persons working at a computer often slouch forward, a posture less than optimal for preventing back problems. It has been observed also that children using a computer move to the front edge of the chair upon which they are sitting when working at a computer. This latter situation can lead to back problems or improper spinal growth in the young.

Many chairs have been designed and marketed to prevent back pain for computer users. These chairs generally provide inter alia an ergonomically designed chair back. However, regardless of the back design, they can not improve posture if the individual sitting in the chair slouches forward or sits on the edge of the chair.

Several approaches have been tried. A lumber roll attached to the lumbar section of a chair back and in electrical communication with an audio warning signal has been suggested. When the sitter is sitting properly and pressing against the roll the circuitry is disengaged from the audio signaler; when the sitter slouches forward the circuit within the lumber roll is closed and the audio signal is sounded. The individual then realizes he is slouching and returns to the desired position again disengaging the audio signal. It is obvious that the electrical circuitry adds to the cost of the lumbar roll. Other electrical or optical systems for posture correction are also known, as are other lumbar support elements attachable to a chair back.

It would be advantageous to provide an article that would train a sitting individual to sit with the proper posture particularly when using a computer. It would be especially advantageous if the article would be usable by the young. Many prior art approaches have drawbacks in that they generally have a relatively complicated construction. As a result, the cost of prior art systems is significantly greater than desirable. A simple, less costly, system is warranted.

SUMMARY OF THE INVENTION

It is an object of the present invention to provide an article which trains people to sit with proper posture, that is, one that increases lordosis of the spine.

It is an object of the present invention to provide an article which will improve the posture of children when sitting, particularly, but not exclusively, when working on a computer.

It is an object of the present invention to provide a technologically simple and inexpensive posture trainer for improving the posture of sitting individuals particularly, but not necessarily exclusively, children.

In one aspect of the present invention there is provided an article for improving the posture of an individual sitting on a chair where the chair includes a seat support portion and a back support portion. The article includes a back covering member positionable on the back support portion of the chair, covering at least a portion thereof. The back covering member is configured to annoy, that is to disturb, the individual when the individual is sitting in a manner deleterious to proper posture. The article also includes means for removably attaching the back covering member to the chair.

In one embodiment of the article, the back covering member is formed to collapse and interfere with the back of the individual when the back of the individual is not pressed up against the back covering member.

In another embodiment of the article, the back covering member is formed to collapse until it lies substantially against the seat support portion of the chair. The member thereby is usable as a seat covering member covering at least a portion of the seat support portion. The seat covering member is configured to disturb the individual when the individual is sitting in a manner deleterious to proper posture.

In yet another embodiment of the article, the seat support portion has a front and back edge, the front edge being distal from the back support portion. The seat covering member is formed to extend past the front edge of the seat support portion of the chair and to interfere with the legs of the individual when the individual is improperly seated on the chair thereby disturbing the individual.

In a further embodiment of the article, the back covering member is formed of cloth covered cardboard, foamed polyurethane or other semi-rigid plastics. Some rigid plastics may also be used.

In still another embodiment of the article, the back covering member is formed to extend over the top of the back support portion of the chair.

In a second aspect of the present invention, there is provided an article for improving the posture of an individual sitting on a chair where the chair includes a seat support portion and a back support portion. The article includes a seat covering member positionable on the seat support portion of the chair, covering at least a portion thereof. The seat covering member is configured to annoy the individual when the individual is sitting in a manner deleterious to proper posture. The article also includes means for removably attaching the seat covering member to the chair.

In an embodiment of the article in the second aspect of the invention, the seat support portion has a front and back edge, the front edge being distal from the back support portion. The seat covering member is formed to extend past the front edge of the seat support portion of the chair and to interfere with the legs of the individual when the individual is improperly seated on the chair.

In yet another embodiment of the article in the second aspect of the present invention, the seat covering member is attached by the means for removably attaching and the seat covering member is rotatable from a position where it lies substantially against the seat portion of the chair to a position where it lies substantially against the back support portion of the chair. In this latter position it is operable as a back covering member.

In still another embodiment of the article in the second aspect of the invention, the back covering member is formed to collapse and interfere with the back of the individual when the back of the individual is not pressed up against the back covering member.

In yet another embodiment of the article in the second aspect of the present invention, the article is formed of cloth covered cardboard or foamed polyurethane.

In yet a third aspect of the present invention, there is provided an article for improving the posture of an individual sitting on a chair where the chair includes a seat support portion and a back support portion. The article includes a back covering member positionable on the back support portion of the chair, and covering at least a portion thereof; a seat covering member positionable on the seat support portion of the chair, and covering at least a portion thereof; and means for removably attaching one or more of the back covering member and the seat covering member to the chair. The back covering member and the seat covering member are configured to interfere with and disturb the individual when the individual is sitting in a manner deleterious to proper posture.

In an embodiment of the article in the third aspect of the present invention, the back covering member and the seat covering member are joined to each other.

In yet another embodiment of the article in the third aspect of the present invention, the seat support portion has a front and back edge, the front edge distal from the back support portion. The seat covering member is formed to extend past the front edge of the seat support portion and to interfere with the legs of the individual when the individual is improperly sitting on the chair. The back covering member is formed to collapse and interfere with the back of the individual when the back of the individual is not pressed up against the back covering member.

In yet another embodiment of the article in the third aspect of the present invention, the seat support portion has a front and back edge, the back edge proximal to, and the front edge distal from, the back support portion. The seat covering member is formed to extend past the front edge of the seat support portion of the chair and to interfere with the legs of the individual when the individual is improperly seated on the chair.

In still another embodiment of the article in the third aspect of the invention, the back covering member is formed to collapse and interfere with the back of the individual when the back of the individual is not pressed up against the back covering member.

In a further embodiment of the article in the third aspect of the present invention, the back covering member and the seat covering member are formed of cloth covered cardboard or foamed polyurethane.

In still another embodiment of the article in the third aspect of the present invention, the back covering member is formed to extend over the top of the back support portion of the chair.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in greater detail than is necessary for a fundamental understanding of the invention. The description taken with the drawings make apparent to those skilled in the art how the several forms of the invention may be embodied in practice.

In the drawings.

DESCRIPTION OF PREFERRED EMBODIMENTS

Figure 1B:
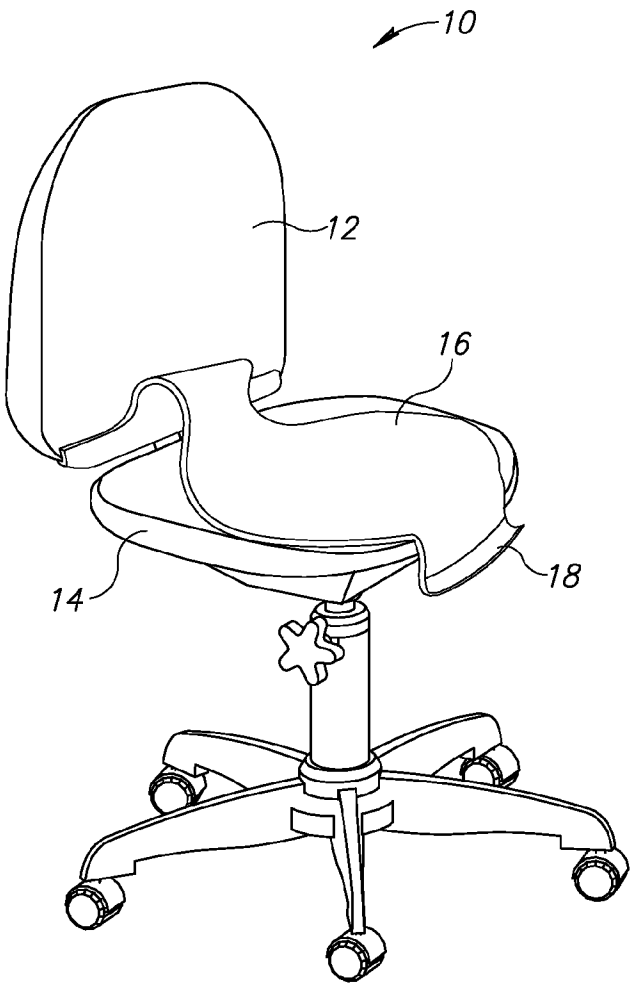
FIGS. 1A-1B provide schematic isometric views of an embodiment of a semi-rigid back covering member and a schematic isometric view of the covering member after it has collapsed, respectively, the covering member constructed according to an embodiment of the present invention.

The present invention provides an article which is intended to improve the posture of a sitting individual. The article is useful particularly, but without limiting the invention, for teaching a child to sit properly when at work on a computer.

The invention provides for a back covering member removably attached to a chair. When the user of the chair slouches forward, the back covering member draws away from the back support portion of the chair and collapses on the back of the slouching user, annoying or disturbing him and interfering with his work. The annoyance is removed when the user sits upright and stops slouching, thereby pressing the back covering member substantially against the back support portion of the chair.

In some embodiments, the back covering member may be rotatable forward or collapse forward to serve as a seat covering member. When the user is sitting improperly in the chair, an interference element on the edge of the seat covering member distal from the back support portion of the chair interferes with the user's feet or knees. This annoyance can be eliminated if the user returns to the proper sitting position.

In yet other embodiments, the initial configuration is a seat covering member. When the user is sitting improperly in the chair, an interference element on the edge of the seat covering member distal from the back support portion of the chair interferes with the user's feet or knees. This annoyance can be eliminated if the user returns to the proper sitting position.

In some embodiments, the seat covering member may be rotatable to a position substantially perpendicular (that is from about 90° to about 100°) to the seat support portion of the chair, thereby serving as a back covering member. If the user of the chair slouches forward, the back covering member draws away from the back support portion of the chair and collapses on the back of the slouching user, annoying him and interfering with his work. The annoyance is removed when the user sits upright and stops slouching pressing the back covering member substantially against the back support portion of the chair.

In yet other embodiments, there may be both a back covering member and a seat covering member joined together with the individual covering members functioning separately but essentially as the back and seat covering members described herein.

In the discussion herein, front of the seat support portion or seat covering member represents the edge or portion of the seat support portion or seat covering member distal from the back support portion; similarly back of the seat support portion or seat covering member is the edge or portion of the seat support portion or seat covering member proximal to the back support portion. When bottom of the back support portion or back covering member is used in the discussion herein, bottom represents the portion of the back support member or back covering member proximal to the seat support member. In a similar vein, top of the back support member or back covering member represents that portion of the back support portion or back covering member distal from the seat support portion.

In the discussion herein, the terms "annoy", "annoying", "annoyance", etc. are being used as essentially equivalent to "disturb", "disturbing", "disturbance", etc. There is no attempt at distinguishing between them.

In FIGS. 1A-4B to be discussed below, the first digit varies and represents the figure number while the second digit is the same for similar parts throughout.

Figure 1A:
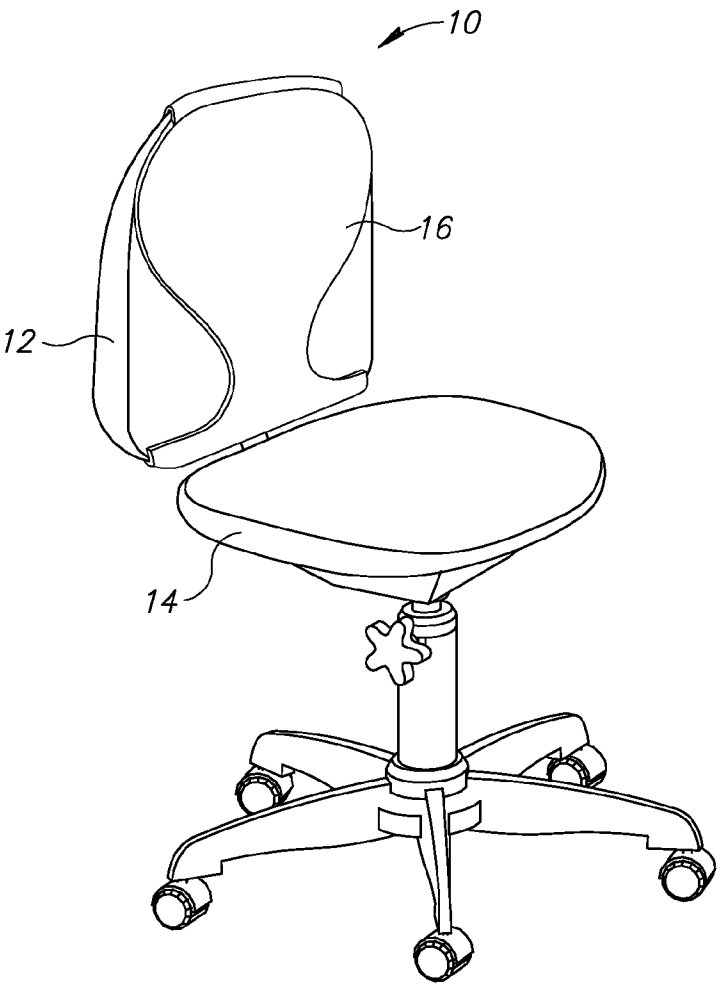

Reference is now made to FIGS. 1A-1B where a back covering member covering a part of a back support portion of a chair and a collapsed back covering member, respectively, are shown.

In FIG. 1A, a back covering member 16 is covering a back support portion 12 of a chair 10. Back covering member 16 has an interference element 18 (FIG. 1B) on its edge distal from seat support portion 14. Back covering member 16 may be formed from semi-rigid materials such as semi-rigid plastics, for example, foamed polyurethane. In other embodiments, such as the one shown in FIG. 2 below, the back support member may be constructed of cloth covered cardboard. These materials are to be recognized as exemplary only and not to be considered as limiting the invention. Other semi-rigid and rigid materials known to persons skilled in the art may also be used. Some of these materials may be recycled materials.

Back covering member 16 may be attached to chair 10 in any number of ways readily comprehended by one skilled in the art. These means for attachment include screws, strings, bands, or elastic material. Some of these methods are discussed herein below in conjunction with FIGS. 5A-6B. Typically, the means of attachment is a means for removably attaching the covering member.

In some embodiments, back covering member 16 may be attached by inserting it into the juncture formed by back support portion 12 and seat support portion 14 of chair 10.

As seen in FIG. 1B, back covering member 16 is attached to chair 10 so that it has some ability to collapse (FIG. 1B) or rotate (FIG. 2) in the direction of seat support portion 14. If an individual is sitting in chair 10 with substantially correct posture, back covering member 16 will be held substantially against back support portion 12. However, if an individual using the chair slouches forward in a less than optimal posture position, back covering member 16 rotates forward (FIG. 2) and/or simply collapses (FIG. 1B) onto the back of the individual. In that collapsed or rotated position, interference element 18 disturbs the individual, interfering with his work, for example, his work on the computer. In order to eliminate the annoyance, the individual must cease slouching forward and push against back covering member 16 so that it is again positioned substantially against back support portion 12. When in this position, interference element 18 of back covering member 16 is so positioned that it ceases to annoy the individual.

When the article is made of plastic, it may be formed to have a non-uniform width and/or a non-uniform thickness. This allows for easier collapse or bending of the article at the position where width and/or thickness are minimal. When cardboard is used to form the article, the collapse of the article can be assisted by allowing collapse along the folds typically formed in the cardboard during the manufacturing process.

Figure 2:
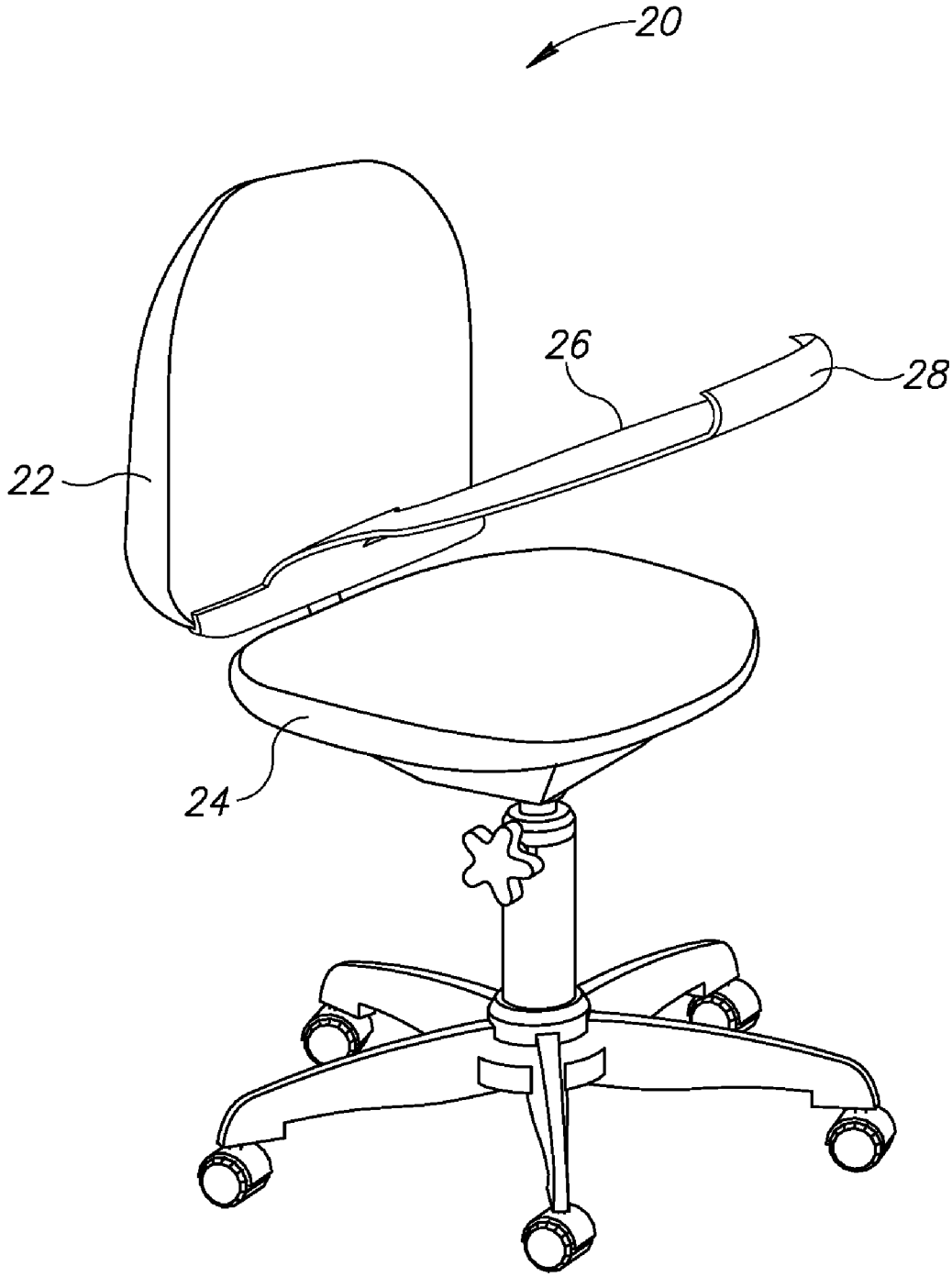
FIG. 2 shows an isometric view of a rigid back covering member collapsing, the back covering member constructed according to another embodiment of the present invention.
Figure 3B:
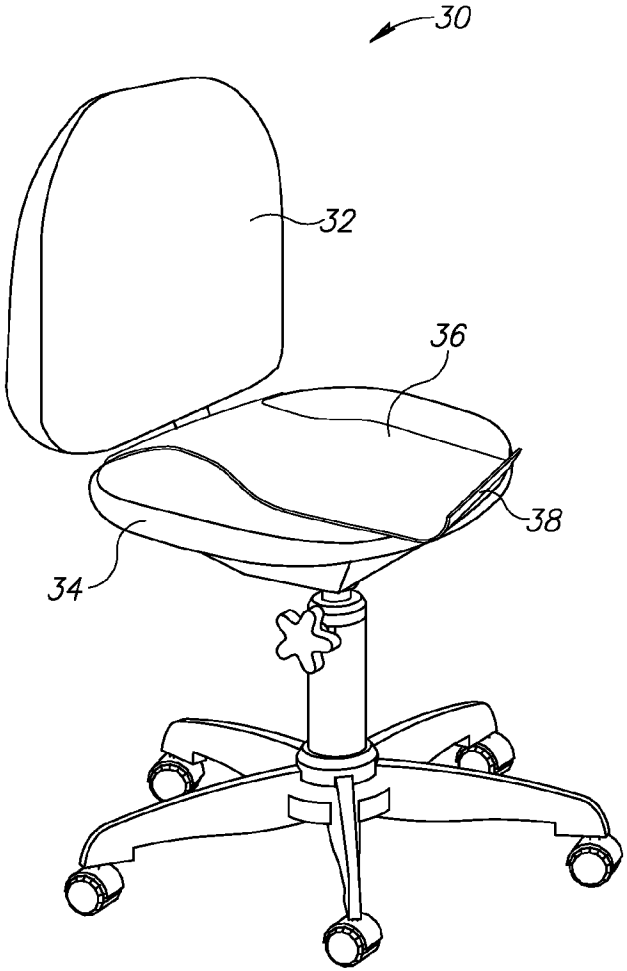
FIGS. 3A-3B provide schematic isometric views of still another embodiment of a back covering member and a schematic isometric view of an analogous seat covering member, respectively, the covering members constructed according to an embodiment of the present invention.
Figure 3A:
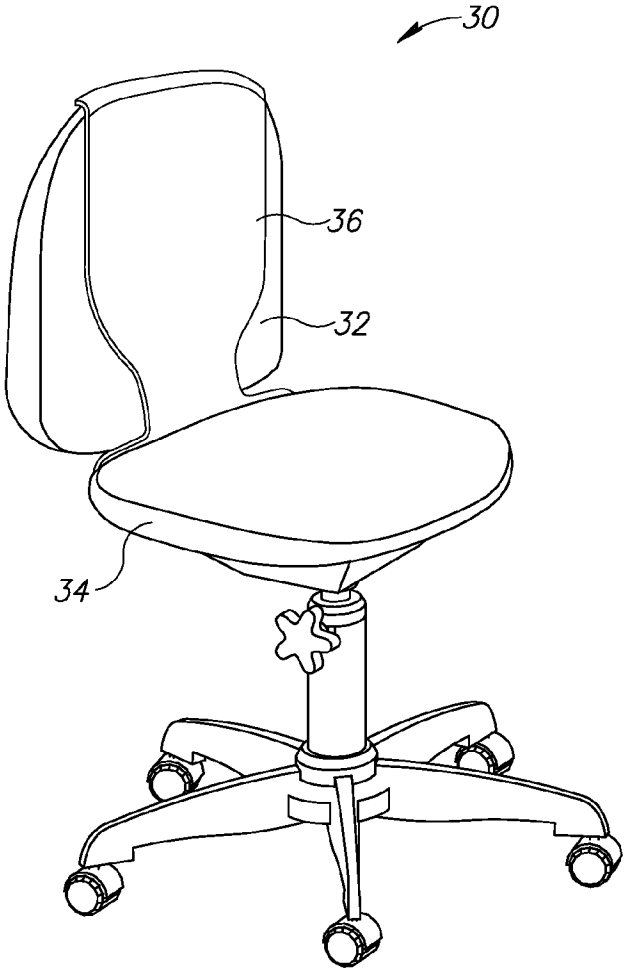
Figure 4B:
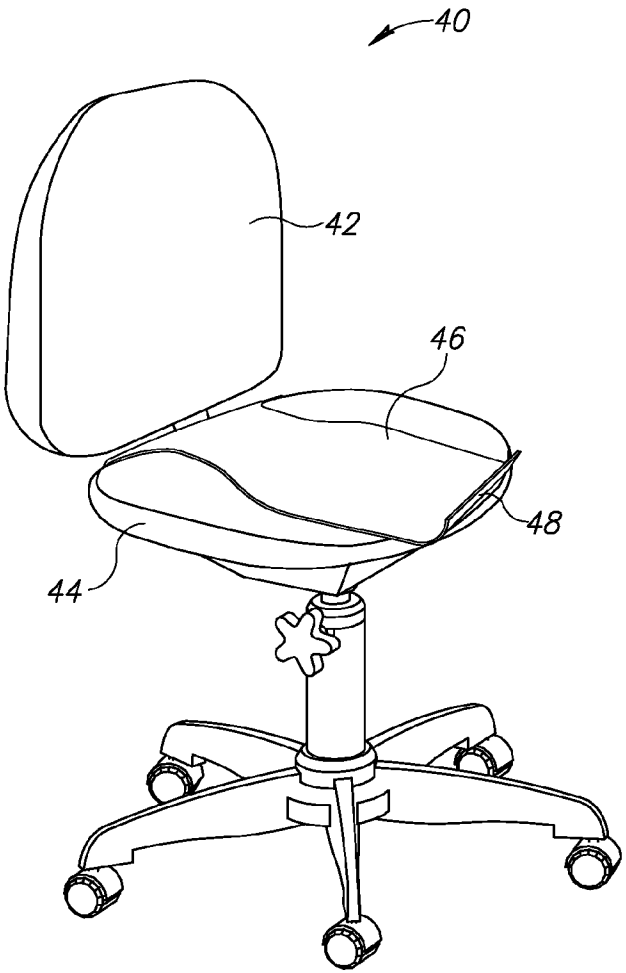
FIGS. 4A-4B provide schematic isometric views of yet another embodiment of a back covering member and a schematic isometric view of yet another seat covering member, respectively, the covering members constructed according to an embodiment of the present invention.
Figure 4A:
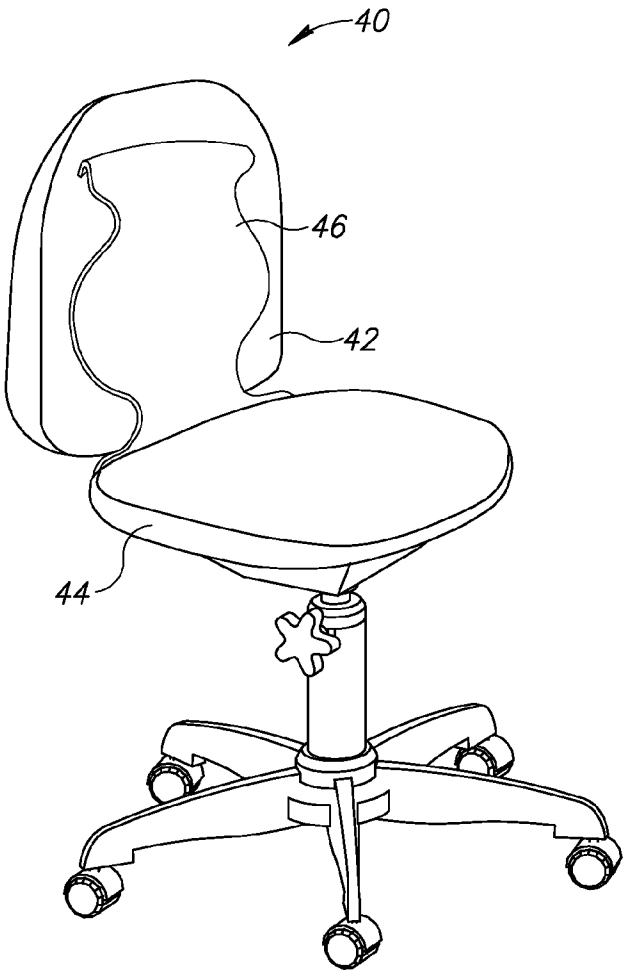

FIGS. 3A and 4A, to which reference is now made, show back covering members having shapes and/or interference elements different from those shown in FIGS. 1A and 2. In these figures, the back covering member functions and is constructed as in FIGS. 1A and 2.

When an individual slouches forward in his chair, back covering member 36 or 46 collapses forward onto the back of the individual, disturbing him and interfering with his work. In order to alleviate the discomfiture, the individual is forced to sit upright with his back again pressing against back covering member 36 or 46, which returns to its position resting substantially against back support portion 32 or 42.

The collapsing stage analogous to that shown in FIGS. 1B and 2 is not shown in FIGS. 3A-4B but can readily be visualized by persons skilled in the art.

Back covering member 36 or 46 of FIGS. 3A and 4A, respectively, can function as a seat covering member as shown in FIGS. 3B and 4B, respectively, when the back covering member rotates about 90° or collapses and lies as shown in FIGS. 3B and 4B.

In addition, the present invention contemplates seat covering members that exist independently of any use of the covering members as back covering members. All seat covering members are constructed and function similarly to those shown in FIGS. 3B and 4B.

The operation of seat covering members is as follows. A seat covering member lies substantially flush against seat support portion 34 or 44 as shown in FIGS. 3B and 4B, respectively. Interference elements 38 and 48 typically extend past the edge of seat support portion 34 and 44, respectively, distal from back support portion 32 and 42, respectively. If an individual is sitting properly when either seat covering member 36 or 46 is used, interference element 38 or 48 does not annoy the individual so as to interfere with his work. When the individual is sitting in an improper position, interference element 38 or 48 annoys the individual by pressing against the individual's legs or the back of his knees. If the individual adjusts his sitting position to a proper sitting position, interference element 38 or 48 ceases to annoy the individual and interfere with his work.

Seat covering members are constructed of the same types of materials as back covering members. These include, but are not to be considered as limiting the invention, cloth covered cardboard, foamed polyurethane and other semi-rigid plastics. Rigid plastics may also be used.

Back covering member 36 and 46 need not cover the entire back support portion as shown in FIGS. 3A and 4A. Similarly, as shown in FIGS. 3B and 4B, seat covering member 36 and 46 need not cover the entire seat support portion.

Interference elements discussed in the embodiments above may be constructed in many different ways having many different forms as should readily be understood by persons skilled in the art.

It should be noted that usually when an individual alters his posture to rid himself of the annoyance or discomfit produced by the interference elements discussed in the embodiments herein, both the individual's back and buttocks simultaneously assume their optimal posture position.

Figure 5B:
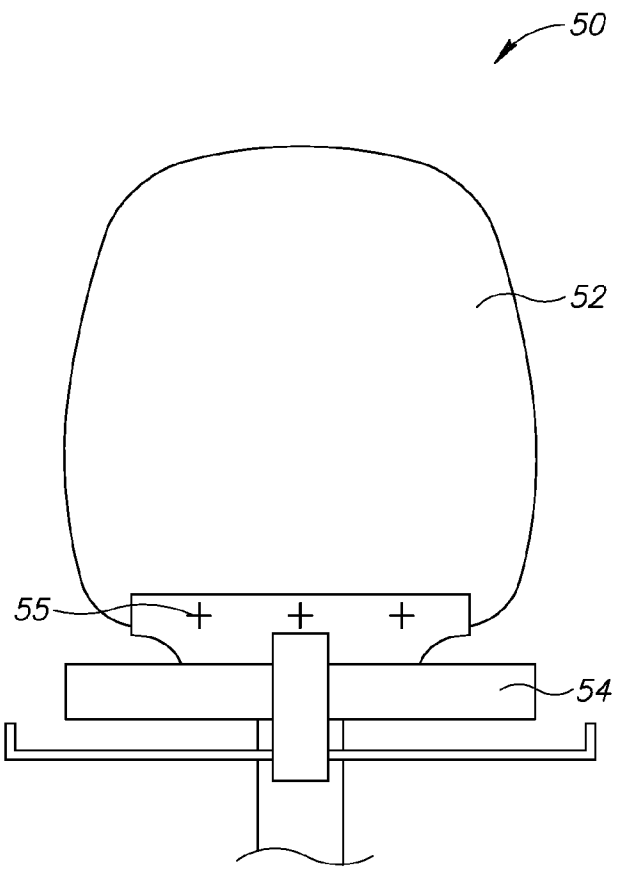
FIGS. 5A-5B show two methods for attaching a back covering member to a chair according to an embodiment of the present invention.
Figure 5A:
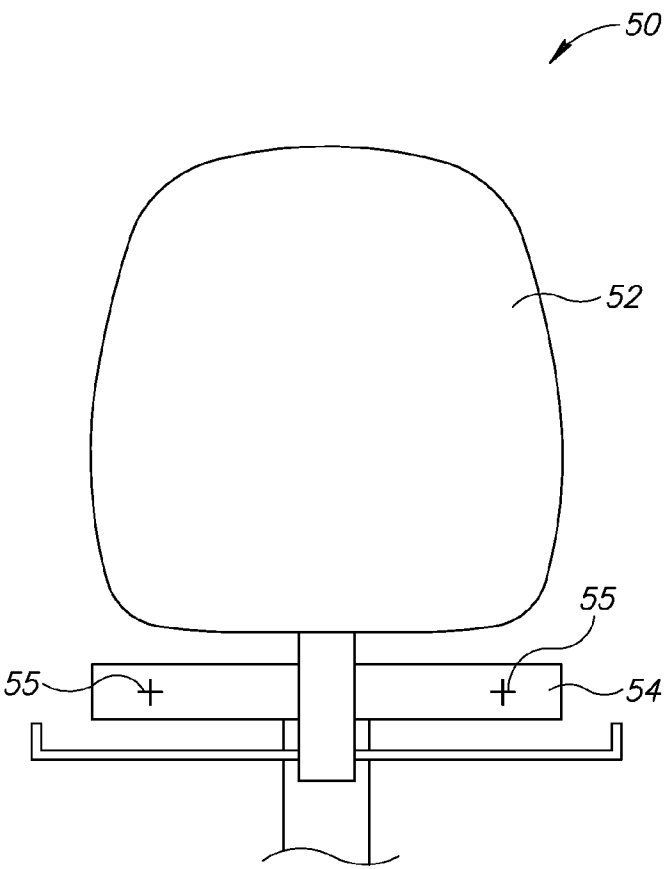

Reference is now made to FIGS. 5A and 5B where two means of removably attaching are shown. In one embodiment, FIG. 5A, screws 55 attach a back covering member (not shown) to the back of seat support portion 54. In another embodiment, FIG. 5B, screws 55 attach a back covering member (not shown) to the back of back support portion 52. Other points of attachment are also possible as would be evident to one skilled in the art.

Figure 6B:
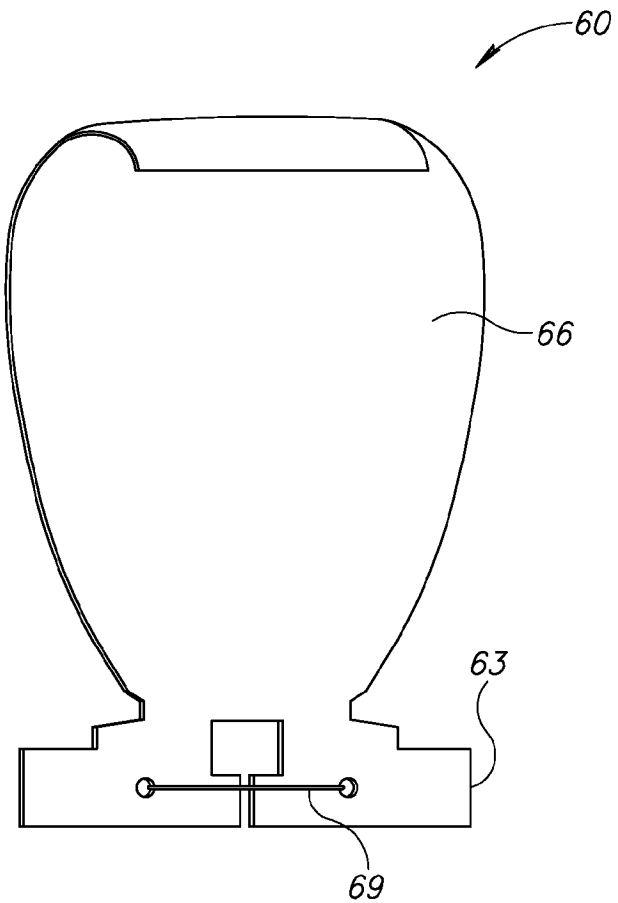
FIGS. 6A-6B show two methods for attaching a back covering member to a chair according to embodiments of the present invention.
Figure 6A:
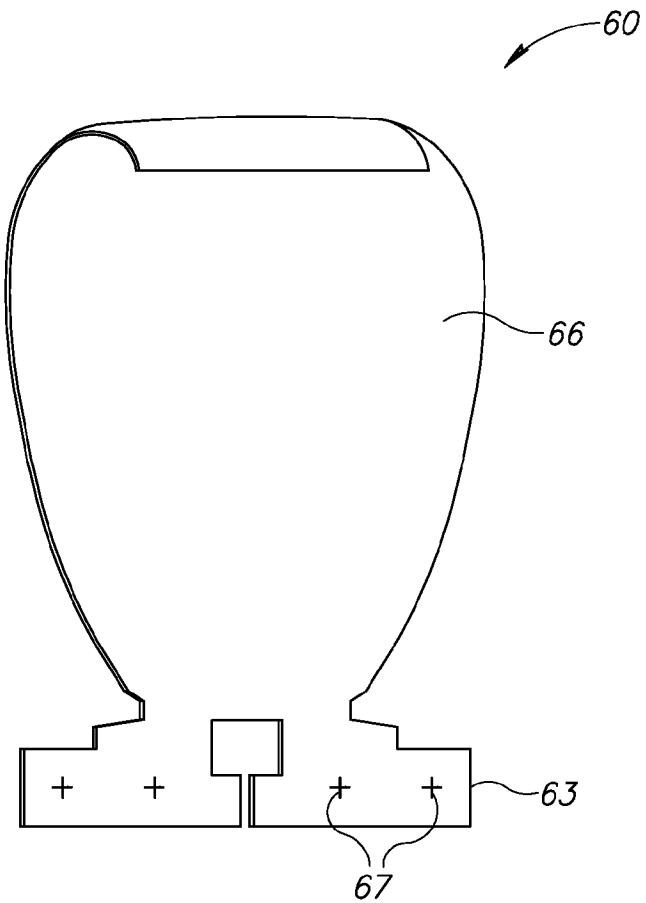

Reference is now made to FIGS. 6A and 6B where additional means of removably attaching a back covering member are shown. FIG. 6A shows attachment of a back covering member 66 at its lower portion 63 to a back support portion (not shown). In this Figure the attachment means may be screws, rivets, eyelets or any other rigid attachment means 67.

FIG. 6B shows attachment of a back covering member 66 at its lower portion 63 to a back support portion (not shown). In FIG. 6B the attachment means is a strip, string, band, or belt-like means formed of flexible elastomers such as rubber, flexible plastic, or, in general, any relatively robust but flexible material 69. All these means typically allow for removable attachment of the back and/or seat covering members.

The means for attaching a back covering member should be of such a construction that it allows for rotation or collapse of the covering member. When the back covering member is intended to serve at times as a seat covering member, the means of attaching should allow for collapse or rotation of the back covering member so that it can rest on the seat support portion of the chair.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In addition, citation or identification of any reference in this application shall not be construed as an admission that such reference is available as prior art to the present invention. Therefore, it will be appreciated by persons skilled in the art that the present invention is not limited by what has been particularly shown and described herein above. Rather, the scope of the invention is defined by the claims that follow.

What is claimed is:

1. An article for improving the posture of an individual sitting on a chair, the chair including a seat support portion and a back support portion, said article comprising:

a back covering member positionable on the back support portion of the chair, covering at least a portion thereof, and configured to disturb the individual when the individual is sitting in a manner deleterious to proper posture; and means for removably attaching said back covering member to the chair wherein said back covering member is formed to collapse and interfere with the back of the individual when the back of the individual is not pressed up against said back covering member.

2. An article according to claim 1, wherein said back covering member is formed to collapse until it lies substantially against the seat support portion of the chair thereby usable as a seat covering member covering at least a portion of the seat support portion, and configured to disturb the individual when the individual is sitting in a manner deleterious to proper posture.

3. An article according to claim 2 wherein the seat support portion has a front and back edge, the front edge distal from the back support portion, and said seat covering member is formed to extend past the front edge of the seat support portion of the chair and to interfere with the legs of the individual when the individual is improperly seated on the chair disturbing the individual.

4. An article according to claim 1, wherein said back covering member is formed of cloth covered cardboard or foamed polyurethane.

5. An article according to claim 1, wherein said back covering member is formed to extend over the top of the back support portion of the chair.

6. An article for improving the posture of an individual sitting on a chair, the chair including a seat support portion and a back support portion, said article comprising:

a seat covering member positionable on the seat support portion of the chair, covering at least a portion thereof, and configured to disturb the individual when the individual is sitting in a manner deleterious to proper posture; and means for removably attaching said seat covering member to the chair;

wherein the seat support portion has a front and back edge, the front edge distal from the back support portion, and said seat covering member is formed to extend past the front edge of the seat support portion of the chair and to interfere with the legs of the individual when the individual is improperly seated on the chair.

7. An article according to claim 6, wherein said seat covering member is attached by said means for removably attaching and whereby said seat covering member is rotatable from a position where it lies substantially against the seat portion of the chair to a position where it lies substantially against the back support portion of the chair where it is operable as a back covering member.

8. An article according to claim 7 wherein said back covering member is formed to collapse and interfere with the back of the individual when the back of the individual is not pressed up against the back covering member.

9. An article according to claim 6, formed of cloth covered cardboard or foamed polyurethane.

10. An article for improving the posture of an individual sitting on a chair, the chair including a seat support portion and a back support portion, said article comprising:

a back covering member positionable on the back support portion of the chair, and covering at least a portion thereof, said back covering member formed to collapse and interfere with the back of the individual when the back of the individual is not pressed up against said back covering member;

a seat covering member positionable on the seat support portion of the chair, and covering at least a portion thereof wherein the seat support portion has a front and back edge, the front edge distal from the back support portion, and wherein said seat covering member is formed to extend past the front edge of the seat support portion and to interfere with the legs of the individual when the individual is improperly sitting on the chair; and means for removably attaching at least one of said back covering member and said seat covering member to the chair, wherein said back covering member and said seat covering member are configured to interfere with and disturb the individual when the individual is sitting in a manner deleterious to proper posture, and said back covering member and said seat covering member are joined to each other.

11. An article according to claim 10, wherein the seat support portion back edge is proximal to, and the front edge is distal from, the back support portion, and said seat covering member is formed to extend past the front edge of the seat support portion of the chair and to interfere with the legs of the individual when the individual is improperly seated on the chair.

12. An article according to claim 10, wherein said back covering member is formed to collapse and interfere with the back of the individual when the back of the individual is not pressed up against the back covering member.

13. An article according to claim 10 wherein said back covering member and said seat covering member are formed of cloth covered cardboard or foamed polyurethane.

14. An article according to claim 10 wherein said back covering member is formed to extend over the top of the back support portion of the chair.

15. An article for improving the posture of an individual sitting on a chair, the chair including a seat support portion and a back support portion, said article comprising:

a back covering member positionable on the back support portion of the chair, covering at least a portion thereof, and configured to disturb the individual when the individual is sitting in a manner deleterious to proper posture; and means for removably attaching said back covering member to the chair, wherein said back covering member is formed to collapse or be rotatable until it lies substantially against the seat support portion of the chair thereby usable as a seat covering member covering at least a portion of the seat support portion, and configured to disturb the individual when the individual is sitting in a manner deleterious to proper posture.

16. An article for improving the posture of an individual sitting on a chair, the chair including a seat support portion and a back support portion, said article comprising:

a seat covering member positionable on the seat support portion of the chair, covering at least a portion thereof, and configured to disturb the individual when the individual is sitting in a manner deleterious to proper posture; and means for removably attaching said seat covering member to the chair, whereby said seat covering member is rotatable from a position where it lies substantially against the seat portion of the chair to a position where it lies substantially against the back support portion of the chair where it is operable as a back covering member.

* * * * *